US005521802A

United States Patent [19]

Edington

[11] Patent Number: 5,521,802

[45] Date of Patent: May 28, 1996

[54] LIGHT ENHANCED MUSIC LABELS

[76] Inventor: Daniel C. Edington, 1621 W. Desert Cove #A1, Phoenix, Ariz. 85029

[21] Appl. No.: 5,039

[22] Filed: Jan. 15, 1993

[51] Int. Cl.[6] ..... F21V 33/00

[52] U.S. Cl. ..... 362/155; 362/86; 362/253

[58] Field of Search ..... 362/86, 87, 155, 362/200, 253, 800; 206/309, 387.1, 216

[56] References Cited

U.S. PATENT DOCUMENTS

| | | | |
|---|---|---|---|
| D. 222,911 | 2/1972 | Weis | D26/14 |
| D. 289,518 | 4/1987 | Kikuchi | D14/1 |
| D. 296,780 | 7/1988 | Kinoshita | D14/11 |
| 3,622,102 | 11/1971 | Fox | 242/199 |
| 4,237,525 | 12/1980 | Deter | 362/104 |
| 4,521,205 | 6/1985 | Spector | 446/302 |
| 4,627,534 | 12/1986 | Komiyama et al. | 206/309 |
| 4,760,502 | 7/1988 | Ackeret | 362/86 |
| 4,914,545 | 4/1990 | Price | 362/155 |
| 4,939,625 | 7/1990 | Olson | 362/154 |

*Primary Examiner*—Ira S. Lazarus
*Assistant Examiner*—Y. Quach

[57] ABSTRACT

An electric light emitting means for the outer protective casings therein housing compact discs and magnetic tape cassettes and the like, accomplished through the use of an electric light emitting means, a power supply and a switch. The system thereof may be used to enhance the images and titles of labels associated with compact discs or magnetic tape cassettes and the like, in dimly lit situations. The usefulness of the illuminated casings is found at the added ease of finding certain materials in adverse lighting conditions; yet, is equally useful in drawing increased attention to a particular compact disc or magnetic tape cassette and the like, in which someone wishes to gain increased exposure thereof. The illuminated casings will therefore enable the music groups insignia, title, group name and the like to be seen and just enjoyed in shaded and dim areas.

8 Claims, 3 Drawing Sheets

LIGHT ENHANCED MUSIC LABELS

BACKGROUND OF THE INVENTION

At the present time the only method of viewing the artistic pictures of compact disc and magnetic tape cassette labels or reading the titles and insignia in adverse lighting conditions is the use of an external lighting means. A dome light in a car or a light in a house or other separate lighting source is needed in order to see the labeling. The previous method of lighting the dome light, can be distracting to the driver or other drivers. Noting in some states the laws do not allow one to drive with the dome light on, due to the reflections from the dome light, emitting inside of and outside of the car. The second method of viewing the compact disc and cassette labels may not be hazardous to one's health; yet, the invention can save you the embarrassment of having to fumble with the lights, when trying to identify the right compact disc or magnetic tape cassette, in a romantic setting. To eliminate the disadvantages of the above referenced method of viewing the labels and to add some pleasure to the user of the compact discs or magnetic tape cassettes, this invention incorporates the use of a lighting means into the protective casings which house the compact disc or magnetic tape cassette. The lighting means allows a viewer to read the labeling or just enjoy the glowing designs on the labels with or without an external light. The invention provides a new way of reading compact disc or magnetic tape cassette labeling and the like in adverse lighting conditions or under any lighting conditions just for enjoyment. The invention relies on PN junctions such as those in relation to diodes and LEDs, and the low amounts of current needed to produce light from PN junctions. The invention was designed to be compact and may be added simply in the manufacturing of the compact disc and magnetic tape cassette protective casings. The before mentioned invention may be retrofitted by cutting a slot in the casing for the switch, as shown in FIG. 1 and FIG. 2. The design of the invention and the introduction of the electronic circuit into the casings is kept relatively simple allowing the overall price to be competitive with the markets that do not offer the invention. The invention represents a minimum amount of alteration to the preceding protective casings; therefore, not effecting those already employed by the manufacturing of individual casings.

The invention relates to an electric light emitting means for compact discs or magnetic tape cassettes and the like. The before mentioned electric light emitting means invented for compact disc or magnetic tape cassette protective housings and the like is for allowing the user to read labels in most lighting conditions good or bad or to receive stimulation to the eyes if they so choose when looking at the electric light emitting means which appears to be of novelty. After further examination more references have been cited. The main citation being U.S. Pat. No. 4,914,545. The disclosure reveals a flashlight for a container which stores a plurality of magnetic tape cassette casings. A music media can not be stored in the light which is rectangular in shape. The invention relies on a lid closed container and a flashlight. The cited invention does not contain a music media within itself. The invention does not work with open faced storage spaces often found in the ergonomics of a car's dashboard. This invention as disclosed could become a dangerous projectile if the invention is used in a car which becomes involved in an accident.

SUMMARY OF THE INVENTION

The invention as designed is a lighting means used to allow people to read compact disc and magnetic tape cassette labeling in limited or unfavorable lighting and the like. In order to achieve the purpose, the compact disc or magnetic tape cassette protective casing is provided with an electric circuit therein with the means to produce light. The lighting means provides energy from a power supply in the form of a battery. The path for the electrons is completed when the switch is activated; thereby, making a complete path for the electrons to flow through the lighting device. All wiring and current flow is represented by electron flow (– to +) but can also be represented by conventional flow (+ to –) and in no way should be construed as being different.

Another object of the invention is the provision of a battery seat. The battery is held in place with the battery seat. The seat consists of an overlaid flap of non-ferrous metal acting as the positive connection and the metal flaps natural resiliency applies pressure to the top of the battery therein. The seat which has the diameter of the battery with a slightly raised outer edge in combination with the positive flap retains the battery. The battery sits on another flap of non-ferrous metal or the like creating the negative connection. Allowing a complete path for the electrons once the switch is activated.

The main objects of the invention are a compact disc and magnetic tape cassette casing having a power supply, in the form of a battery, a light emitting means, in the form of a super or ultra bright LED (light emitting diode) and an electrical connection between the power supply and the lighting means and the switch. The lighting product is made up of either a singular or plural amount of LEDs (light emitting diodes) and the like. The lighting means is used to light (to make visible what was previously a darker contrast with the use of a lighting means) paper labeling inside the casing or labeling that is painted, etched or applied thereof to the outer or inner facial surface of the protective casing which houses the compact disc or magnetic tape cassette.

A further object of the invention is to enable the switch to be connected to the circuit and the case without causing a gross difference between the original casings and the casings that incorporate the use of the invention therein. The original protective casings will only have to be slightly modified. The main modification being a single hole cut or drilled in the case as shown in FIG. 1 and FIG. 2 for the switch to be operated without having to open the compact disc or magnetic tape cassette casings. The invention may be operated with the casings open in most models of the invention. A small single shot switch (a switch which is only activated when the switch is compressed) is used with the best results. Although that does not exclude any other switches and the like, which are of appropriate size from being used.

Another object of the invention deals with the electric light emitting means and the configuration of the LEDs. The arrangement of the LEDs is only determined by the way in which someone wishes to light the casings or the contents therein. LEDs may be laid flat projecting light outward from all sides of the compact disc or magnetic tape cassette casings. The LEDs can also be used to create an intense illumination across the face of the casing. Therefore almost any desired configuration and art may be illuminated within or thereon the casings.

DETAILED DESCRIPTION OF THE INVENTION

As before mentioned all electric currents in all embodiments, for the purpose of simplicity, will be in electron flow (– to +) but can be explained using the theory of conventional flow (+ to –) and in no way should be construed as being different.

First Embodiment

Figure 1:
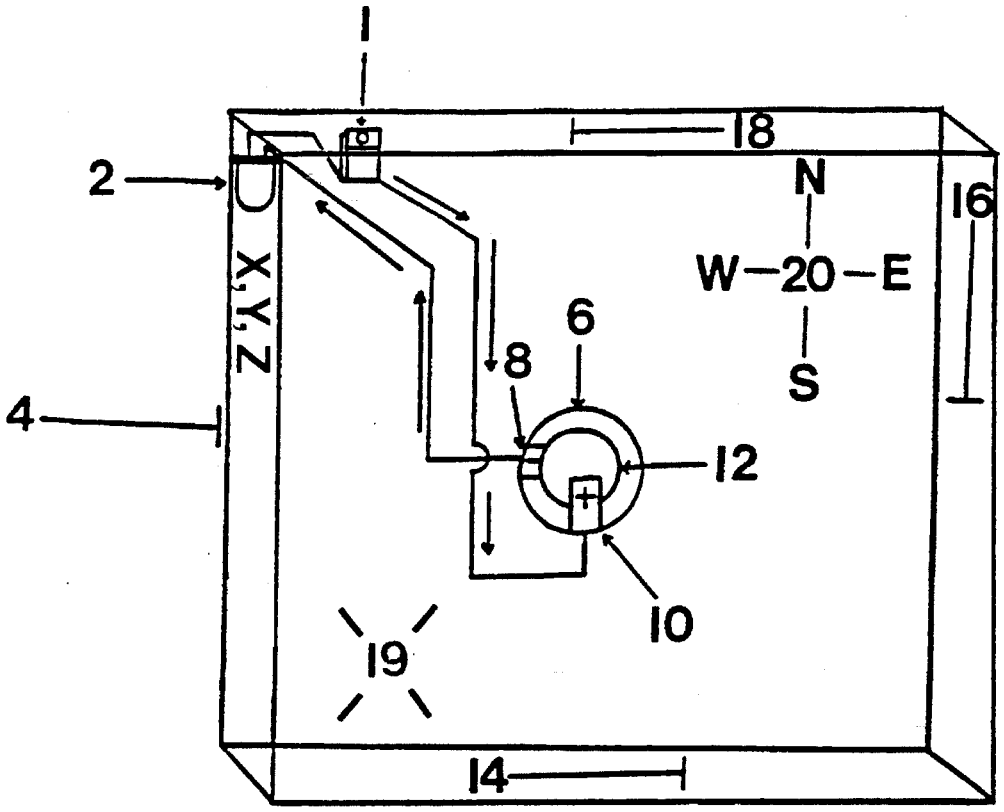
FIG. 1 is a view of the transparent outer protective casing for a compact disc in which the invention is contained.
Figure 2:
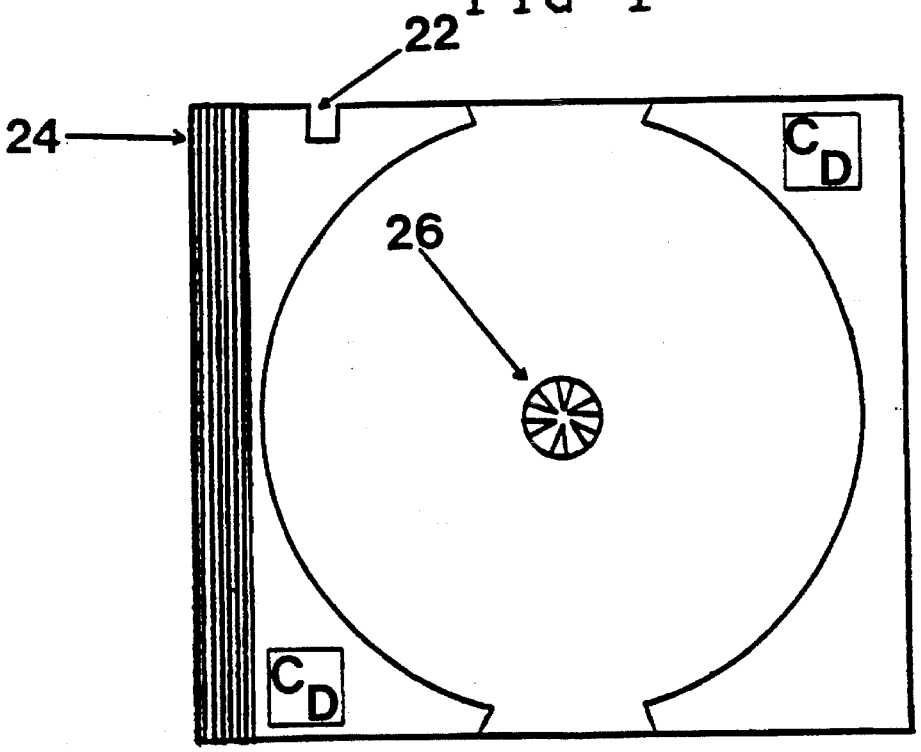
FIG. 2 is a view of the skeletal structure, defined as supporting structure or framework, used inside the transparent outer protective casing used to stabalize a compact disc.

Referring to the drawings in FIG. 1 and 2, numeral 1 designates a manual pressure activated switch means, a light emitting diode 2, a label (title) applied to the inner or outer portion of the west side 4 of the outer protective casing for a compact disc. A seat 6 as a means to contain the battery 12. A negative lead 8 for the battery 12 to sit thereon, a positive lead 10 to sit thereon the battery for stability. A battery 12 as a means to supply current and voltage. An east side of casing thereof 16. A south side of casing thereof 14, a west side of casing thereof 4, a north side of casing thereof 18, a compass 20 for designating sides of the said casing. The numeral 19 designates the face and back of the outer protective casing which is transparent. A slot 22 cut out of the skeletal structure therein the transparent casing thus allowing room for the switch 1. Raised edge 24 of the inner skeletol structure which covers the diode 2 when FIG. 1 and FIG. 2 are combined. A protrusion 26 to stabilize a compact disc. When switch 1 is compressed current begins to flow out of the battery 12 through negative lead 8. As the voltage enters the cathode side of the light emitting diode 2, through an electrical connection, an energy field builds to 0.7 volts forward biasing the LED 2 and light is emitted thereof. The excess electrons flow out of the anode of the LED 2 followed therethrough the switch 1. After passing therethrough the switch the remaining electrons recirculate through an electrical connection into the positive side of the battery 12 therethrough positive lead 10 thus completing the circuit and allowing the desired label and the like to be lit.

Second Embodiment

Figure 3:
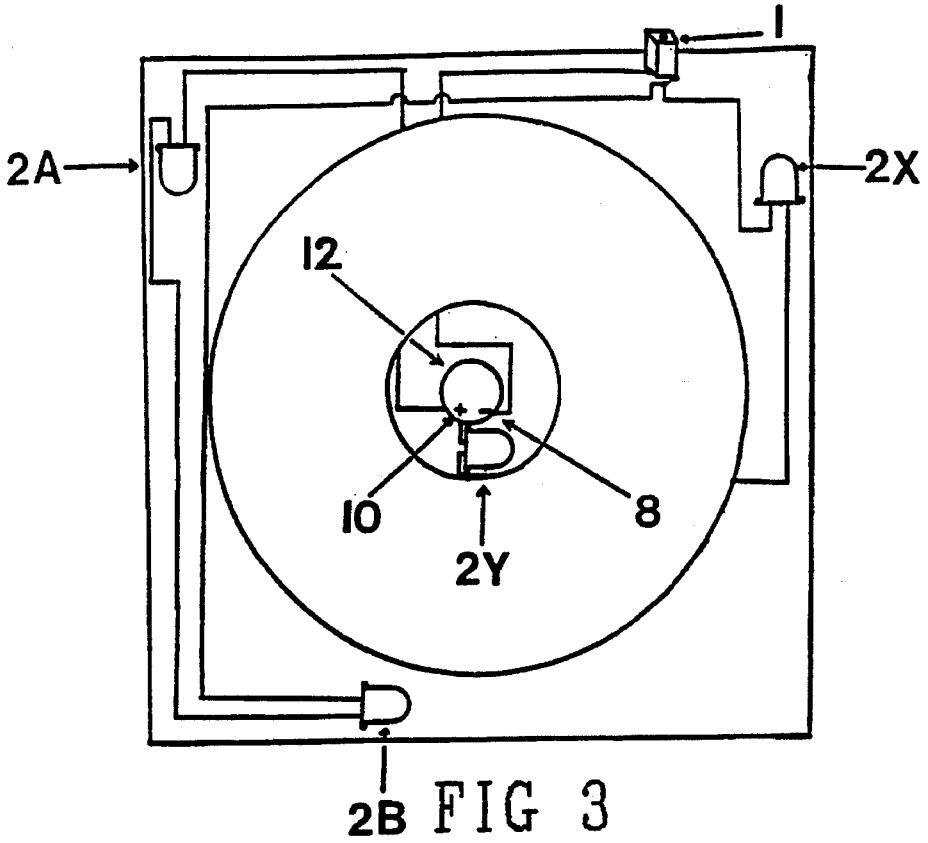
FIG. 3 is a schematic view of a multi-diode configuration of the invention contained in a compact disc outer protective casing containing the compact disc inside.
Figure 4:
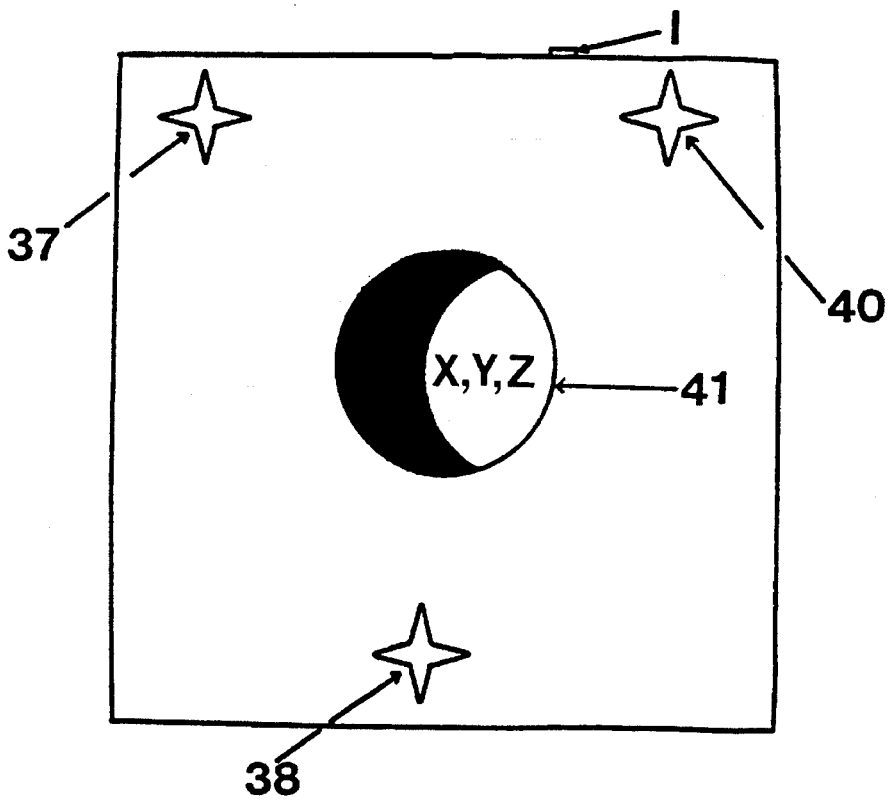
FIG. 4 is the end result of the above outer protective casing when the casing is closed, demonstrating the design that is illuminated.

Referring to the drawings in FIG. 3 and 4, numeral 1 designates a manual pressure switch. The numbers 2A,2B, 2X,2Y represent LEDs (light emitting diodes) therein FIG. 3. The numeral 12 designates the battery which is a means to supply voltage and current thereof. The numeral 1 as designated thereinabove also represents the pressure switch of FIG. 4. The numerals 37,38,40 represent stars that appear illuminated when the LEDs are energized therein the outer protective casing. The numeral 41 designates a moon that is illuminated when the LED designated by the numeral 2Y becomes forward biased. Again referring to FIG. 3, when the pressure switch designated by numeral 1 is pressed current begins to flow. The LEDs 2A,2B are electrically connected in series with each other while being in parallel with LEDs 2X,2Y which are electrically connected in series with each other also. When the switch designated by numeral 1 is compressed a complete current path forms therefrom, current flows from the negative lead 8 of the battery 12, therethrough the cathodes of both LEDs 2B,2X. A voltage of 0.7 volts forward biases both LEDs 2B,2X allowing current to travel back out of the anodes into the cathodes of the LEDs designated by the numerals 2A,2Y. Again 0.7 volts forward biases the LEDs this time designated by numerals 2A,2Y. The current continues to flow there through all LEDs, lighting the LEDs, 2A,2B,2X,2Y and the remaining current completes the electron path to the battery 12.

Third Embodiment

Figure 5:
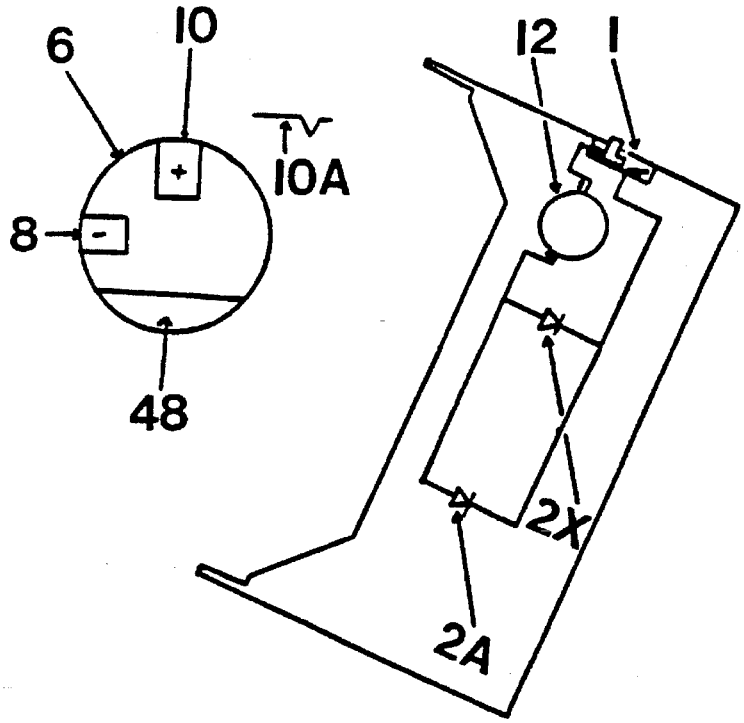
FIG. 5 is a view of the stabilization section of a magnetic tape cassette which forms the backing thereof with said cassette closed.
Figure 6:
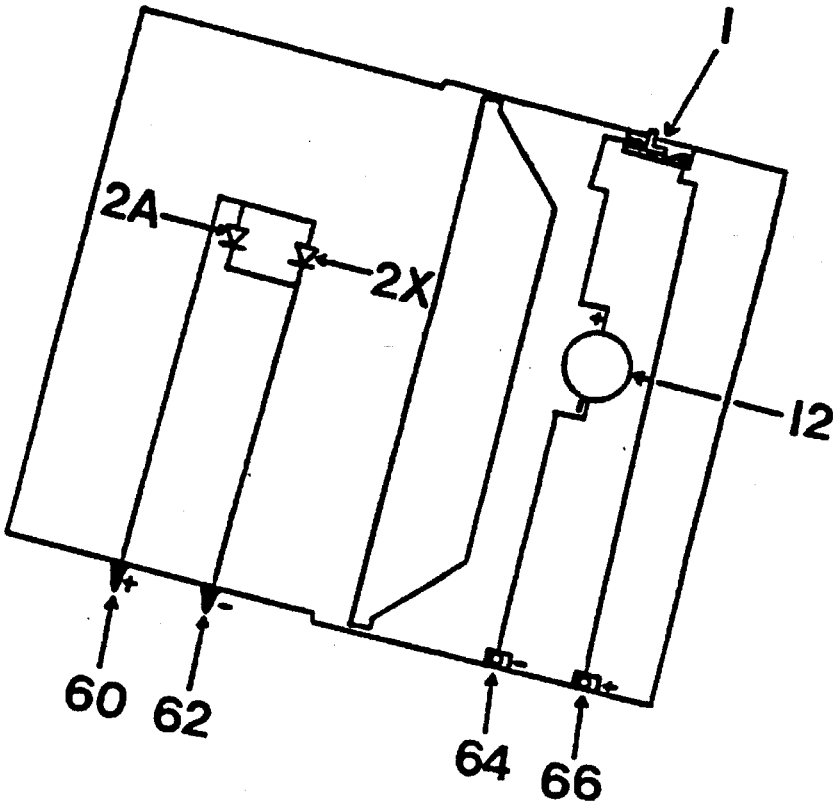
FIG. 6 is an open view of an entire outer protective casing for a magnetic tape cassette said tape cassette being open and face down.

When referring to FIG. 5 and FIG. 6 the components will be thoroughly explained whereas the same electrical current path and function of the components is previously explained. The electric current path is parallel in FIG. 5 and FIG. 6 and identical to either of the LEDs in parallel in FIG. 3.

When referring again to FIG. 5, numeral 10 designates the positive lead of the battery seat. The numeral 6 designates the actual seat, whereas numeral 8 designates the negative lead the battery 12 sits thereon and 48 designates an added flap of non-conductive material to sit thereon the battery. The numeral 10A designates the bend used to add resiliency to the positive lead 10. The switch 1 is an open view thereof and is used to systematically complete the circuit therebetween battery 12 and the LEDs in parallel designated by numerals 2A,2X. The same numerals designate the same components comprising FIG. 6 and one added feature therein being the sip sockets (micro electronic plugs) the male ends 60,62 and the female ends therein designated with numerals 64,66 which must be in contact with each other in order to complete the current path for FIG. 6. The configuration of the LEDs is also different in FIG. 5 and FIG. 6 and can be in any design needed to illuminate that particular label.

I claim:

1. A storage case means for storing an individual magnetic tape cassette comprising a transparent magnetic tape cassette casing storing an individual magnetic cassette tape; at least a light source mounted within said transparent cassette casing to illuminate said casing; electrical circuit means encompassing a manual operated switch electrically connecting a power supply within said cassette casing to said light source; and said electric circuit means positioned within said transparent cassette casing.

2. A storage case means for storing an individual magnetic tape cassette of claim 1 wherein said light source is a super bright LED.

3. A storage case means for storing an individual magnetic tape cassette of claim 1 wherein said light source is a blinking LED.

4. An apparatus for illuminating a transparent compact disc case comprising a transparent casing having a front face cover associated with a housing, said housing including a back wall interconnecting to a plurality of side walls, said housing further including a protrusion insertable into a void in a center of an individual compact disc; a light emitting means within said casing; a power supply and a switch; said light emitting means electrically connected to said power supply and said switch to form a circuit, said circuit positioned within said transparent casing; and whereby light emitting from the light emitting means illuminates the face cover, back wall and side walls of said transparent casing storing the individual compact disc.

5. An apparatus for illuminating a transparent compact disc case of claim 4 wherein said light emitting means is a super bright LED.

6. An apparatus for illuminating a transparent compact disc case of claim 4 wherein said power supply is a rechargeable lithium battery.

7. An apparatus for illuminating a transparent compact disc case of claim 4 wherein said light emitting means is a blinking LED.

8. An apparatus for illuminating a transparent compact disc case of claim 4 wherein said light emitting means is a light bulb.

* * * * *